US011739967B1

(12) United States Patent
Craft et al.

(10) Patent No.: US 11,739,967 B1
(45) Date of Patent: Aug. 29, 2023

(54) SYSTEM AND METHOD FOR EVALUATING AIR CONDITIONER PERFORMANCE AT PART-LOAD CONDITIONS

(71) Applicant: Kentuckiana Curb Company, Inc., Louisville, KY (US)

(72) Inventors: Rob Craft, Mount Pleasant, SC (US); Kevin Muldoon, Goshen, KY (US)

(73) Assignee: KENTUCKIANA CURB COMPANY, INC., Louisville, KY (US)

( * ) Notice: Subject to any disclaimer, the term of this patent is extended or adjusted under 35 U.S.C. 154(b) by 0 days.

(21) Appl. No.: 18/084,215

(22) Filed: Dec. 19, 2022

Related U.S. Application Data

(60) Provisional application No. 63/292,178, filed on Dec. 21, 2021.

(51) Int. Cl.

| | |
|---|---|
| ***F24F 11/63*** | (2018.01) |
| ***F24F 11/74*** | (2018.01) |
| ***F24F 11/80*** | (2018.01) |
| *F24F 140/50* | (2018.01) |

(52) U.S. Cl.
CPC ..... *F24F 11/63* (2018.01); *F24F 11/74* (2018.01); *F24F 11/80* (2018.01); *F24F 2140/50* (2018.01)

(58) Field of Classification Search
CPC .. F24F 11/63; F24F 11/74; F24F 11/80; F24F 2140/50
See application file for complete search history.

(56) References Cited

U.S. PATENT DOCUMENTS

| | | | | |
|---|---|---|---|---|
| 6,775,995 | B1 | 8/2004 | Bahel et al. | |
| 7,010,926 | B2 | 3/2006 | Bahel et al. | |
| 7,606,683 | B2 | 10/2009 | Bahel et al. | |
| 7,908,126 | B2 | 3/2011 | Bahel et al. | |
| 10,885,238 | B1 | 1/2021 | Packer et al. | |
| 2014/0372164 | A1* | 12/2014 | Egan | G06T 11/206 705/7.22 |
| 2016/0290667 | A1* | 10/2016 | Tamaru | F24F 11/58 |
| 2017/0268792 | A1* | 9/2017 | Costakis | F25B 23/006 |
| 2019/0101314 | A1* | 4/2019 | Muthusubramanian | F25B 49/022 |
| 2019/0178522 | A1* | 6/2019 | Sun | G05D 23/1931 |
| 2020/0080742 | A1* | 3/2020 | Okamoto | F24F 11/56 |
| 2020/0129896 | A1* | 4/2020 | Kono | F24F 8/192 |
| 2020/0149754 | A1* | 5/2020 | K | F24F 3/153 |

(Continued)

FOREIGN PATENT DOCUMENTS

EP 2626754 A1 8/2013

*Primary Examiner* — Nelson J Nieves
(74) *Attorney, Agent, or Firm* — NEO IP

(57) ABSTRACT

A system generates performance data, including supply air temperature and supply air dew point temperature, of an air conditioning device when provided with parameters of the air conditioning device, such as specifications of individual components of the air conditioning device. The system automatically modulates operating parameters for the simulated air conditioning device in order to achieve set point conditions and subsequently provides suggested operating parameters for the air conditioning device to enable the air conditioning device to achieve a set point temperature, a set point relative humidity, and/or a set point dew point temperature at one or more part-load conditions. In one embodiment, the system automatically calibrates the air conditioning device to operate the device to achieve user-defined setpoints.

20 Claims, 10 Drawing Sheets

(56) References Cited

U.S. PATENT DOCUMENTS

| | | | | |
|---|---|---|---|---|
| 2020/0166237 | A1* | 5/2020 | Speaker | F24F 11/65 |
| 2020/0363776 | A1* | 11/2020 | Burroughs | H04L 12/2827 |
| 2022/0186996 | A1* | 6/2022 | Goel | F24F 3/14 |
| 2022/0268456 | A1* | 8/2022 | Goel | F25B 47/006 |
| 2022/0316719 | A1* | 10/2022 | Theriault | F24F 5/00 |
| 2022/0373206 | A1* | 11/2022 | Tillack | F24F 11/64 |

* cited by examiner

Dedicated Outdoor Air Solutions

Home | Dashboards | My Projects | Tools | Administration

Possible Selections

Model:

Valid sizes for your input conditions are shown below. Select a size or click Cancel to reselect.

| Select a Size | Size 1 | Size 2 | Size 3 | Size 4 | Size 5 |
|---|---|---|---|---|---|
| **Unverified Unit List Price** | | | | | |
| **SUPPLY FAN** | | | | | |
| Total CFM | 2000 | 2000 | 2000 | 2000 | 2000 |
| Outside Air CFM | 2000 | 2000 | 2000 | 2000 | 2000 |
| ESP | 0.75 | 0.75 | 0.75 | 0.75 | 0.75 |
| TSP | 1.10 | 1.11 | 1.13 | 0.99 | 1.00 |
| Fan Motor BHP | 0.49 | 0.49 | 0.50 | 0.45 | 0.45 |
| Fan Motor HP | 1 | 1 | 1 | 1 | 1 |
| **COOLING PERFORMANCE** | | | | | |
| Total MBH Gross | 146 | 164.4 | 190.7 | 202.2 | 218.6 |
| Total MBH Net | 144.8 | 163.2 | 189.4 | 201.1 | 217.5 |
| Sensible MBH Gross | 79.4 | 86.5 | 97.6 | 102.9 | 110.5 |
| Sensible MBH Net | 78.2 | 85.3 | 96.3 | 101.8 | 109.4 |
| Entering Air Coil DB / WB | 96/79 | 96/79 | 96/79 | 96/79 | 96/79 |
| Leaving Air Coil DB / WB | 60.4/59.7 | 57.3/56.5 | 52.3/51.7 | 49.9/49.4 | 46.5/46.0 |
| Leaving Air DB (Reheat) | 89.7 | 89.7 | 89.8 | 89.8 | 89.4 |
| Leaving Air WB (Reheat) | 69.48 | 67.86 | 65.78 | 64.85 | 63.39 |
| Leaving Air Unit DB / WB | 90.4/69.7 | 90.4/68.1 | 90.5/66 | 90.4/65.1 | 90/63.6 |
| Face Velocity | 191 | 191 | 191 | 115 | 115 |
| Evaporator Rows | 6 | 6 | 6 | 6 | 6 |
| Evaporator FPI | 14 | 14 | 14 | 14 | 14 |
| EER @ Operating Conditions | 15 | 15.1 | 14 | 13.6 | 12.7 |
| Evaporator Face Area | 10.42 | 10.42 | 10.42 | 17.36 | 17.36 |
| Watts | 9648 | 10800 | 13531 | 14740 | 17066 |

FIG. 3

Dedicated Outdoor Air Solutions

Home | Dashboards | My Projects | Tools | Administration | Resources | Sign Out

Part Load Performance Estimator

Unit Information

Tag: DOAS-1
Model:
Unit Model Number:

Selection Validation

| Unit Performance Validation | Unit Performance will need to be validated before Part Load estimation. |
|---|---|
| ✔ Unit Performance Validated | Full unit performance required for Part Load estimation. |
| ✔ Digital Scroll Compressor Selected | Digital scroll compressor(s) are required on all circuits for Part Load Data. |
| ✔ Hot Gas Reheat | Hot Gas Reheat required for Part Load estimation. |
| ✔ Head Pressure Control | Head Pressure Control is required for Part Load estimation. Please select the available option before continuing. |
| ✔ Calculated Dew Point 50°F or Below | Part Load Performance is only available for units with a supply air dew point of 50°F or below |
| ✔ 100% Outside Air Limit | Part Load Performance is only available for units with 100% outside air. |
| ✔ DX Unit Selected | Only DX units are supported at this time. |
| ✔ Piezo Ring | Unit must have a piezo ring. |

User Defined Ratings

| | | EAT DB (°F) | EAT WB (°F) |
|---|---|---|---|
| | | 96 | 79 |
| | | 95 | 78 |
| | | 80 | 73 |
| | | 70 | 66 |
| | | 63 | 59 |
| | | 72 | 70 |
| | | 70 | 68 |
| | | 66 | 64 |
| | | 63 | 61 |
| | | 59 | 57 |
| | | 55 | 54 |

Add New

Calculate Part Load | Return to Selection | Return to Pricing | Back to Schedule

FIG. 5

| Point | CFM | Amb. DB (°F) | OA DB (°F) | OA WB (°F) | ERV DB (°F) | ERV WB (°F) | Total Cap. (Btu/hr) | Sens. Cap. (Btu/hr) |
|---|---|---|---|---|---|---|---|---|
| 920A | 970 | 95.0 | 95.0 | 78.0 | 78.4 | 65.9 | 100,636 | 50,800 |
| 920B | 970 | 80.0 | 80.0 | 73.0 | 75.9 | 64.8 | 79,750 | 34,945 |
| 920C | 970 | 70.0 | 70.0 | 66.0 | 74.1 | 63.3 | 54,554 | 24,609 |
| 920D | 970 | 63.0 | 63.0 | 59.0 | 63.0 | 59.0 | 33,638 | 17,695 |

FIG. 6A

| Point | Evap. DB (°F) | Evap. WB (°F) | Evap. DP (°F) | MRC (lbs H2O/hr.) | MRE (lbs H2O/kWh) | HGRH LAT (°F) | HGRH Cap. (Btu/hr.) | Supp. Heat (Btu/hr.) |
|---|---|---|---|---|---|---|---|---|
| 920A | 47.2 | 46.3 | 45.6 | 45.2 | 9.11 | 72.9 | 27,181 | 0 |
| 920B | 47.3 | 46.4 | 45.8 | 41.0 | 8.77 | 73.8 | 28,176 | 0 |
| 920C | 47.0 | 46.3 | 45.8 | 27.7 | 5.82 | 73.7 | 28,334 | 0 |
| 920D | 46.4 | 45.8 | 45.4 | 15.0 | 3.89 | 73.7 | 28,944 | 0 |

FIG. 6B

| Point | CFM | Amb. DB (°F) | OA DB (°F) | OA WB (°F) | ERV DB (°F) | ERV WB (°F) | Total Cap. (Btu/hr) | Sens. Cap. (Btu/hr) |
|---|---|---|---|---|---|---|---|---|
| Design | 970 | 95.0 | 75.0 | 78.0 | 78.4 | 66.3 | 99,738 | 50,361 |
| PLD1 | 970 | 72.0 | 72.0 | 70.0 | 74.5 | 64.6 | 68,221 | 26,454 |
| PLD2 | 970 | 70.0 | 70.0 | 68.0 | 74.1 | 64.2 | 61,228 | 24,453 |
| PLD3 | 970 | 66.0 | 66.0 | 64.0 | 73.5 | 63.3 | 47,313 | 20,127 |
| PLD4 | 970 | 63.0 | 63.0 | 61.0 | 63.0 | 61.0 | 37,445 | 16,610 |
| PLD5 | 970 | 59.0 | 59.0 | 57.0 | 59.0 | 57.0 | 21,392 | 7,197 |
| PLD6 | 970 | 55.0 | 55.0 | 54.0 | 55.0 | 54.0 | 19,079 | 8,655 |

FIG. 7A

| Point | Evap. DB (°F) | Evap. WB (°F) | Evap. DP (°F) | MRC (lbs H2O/hr.) | MRE (lbs H2O/kWh) | HGRH LAT (°F) | HGRH Cap. (Btu/hr.) | Supp. Heat (Btu/hr.) |
|---|---|---|---|---|---|---|---|---|
| Design | 47.7 | 46.7 | 46.0 | 44.8 | 9.02 | 73.1 | 27,034 | 0 |
| PLD1 | 47.3 | 46.5 | 46.0 | 38.5 | 7.83 | 74.1 | 28,389 | 0 |
| PLD2 | 47.2 | 46.4 | 45.9 | 33.9 | 7.00 | 74.1 | 28,560 | 0 |
| PLD3 | 47.3 | 46.6 | 46.1 | 25.3 | 4.81 | 74.1 | 28,498 | 0 |
| PLD4 | 47.5 | 46.8 | 46.3 | 19.6 | 4.59 | 74.0 | 28,154 | 0 |
| PLD5 | 52.3 | 48.7 | 45.7 | 13.4 | 4.48 | 73.9 | 22,942 | 0 |
| PLD6 | 46.9 | 46.2 | 45.7 | 9.8 | 3.83 | 74.1 | 28,872 | 0 |

FIG. 7B

SYSTEM AND METHOD FOR EVALUATING AIR CONDITIONER PERFORMANCE AT PART-LOAD CONDITIONS

CROSS-REFERENCES TO RELATED APPLICATIONS

The application is related to and claims priority from the following U.S. patent documents: this application claims priority from U.S. Provisional Patent Application No. 63/292,178, filed Dec. 21, 2021, which is incorporated herein by reference in its entirety.

BACKGROUND OF THE INVENTION

1. Field of the Invention

The present invention relates to systems and methods for simulating air conditioner performance, and more specifically to systems and methods for evaluating air conditioner outputs at various part-load conditions and simulating air conditioning units with various operating parameters in order to achieve desired set point conditions.

2. Description of the Prior Art

It is generally known in the prior art to provide computer-based psychrometric chart analysis, with programs such as PSYCHART. Additionally, it is known in the art to simulate thermal behavior of a whole building including an air conditioning system, with programs such as ENERGYPLUS.

Prior art patent documents include the following:

U.S. Pat. No. 7,606,683 for Cooling system design simulator by inventors Bahel et al., filed Jan. 27, 2004 and issued Oct. 20, 2009, discloses a method of computer-based simulation of a cooling system including inputting condenser parameters, evaporator parameters and compressor parameters for the cooling system and processing the condenser parameters, the evaporator parameters and the compressor parameters through a model of the cooling system. A flow control device is selected based on an output of the model.

U.S. Pat. No. 7,908,126 for Cooling system design simulator by inventors Bahel et al., filed Apr. 28, 2006 and issued Mar. 15, 2011, discloses a method of computer-based simulation of a cooling system including receiving configuration data for a heat exchanger of the cooling system, customizing the configuration data for the heat exchanger; simulating cooling system performance by processing the customized configuration data through a model of the cooling system, and generating simulated cooling system performance data, based on the simulating, for evaluating operation of the cooling system.

U.S. Pat. No. 6,775,995 for Condensing unit performance simulator and method by inventors Bahel et al., filed May 13, 2003 and issued Aug. 17, 2004, discloses a method of determining thermal performance of a condenser and a condensing unit within a cooling system including selecting the condenser and the condensing unit from a condensing unit database. A compressor is selected from a compressor database based on at least one of capacity, electrical characteristics and refrigerant flowing through the cooling system. Simulation points for the cooling system are determined and condensing unit characteristics and compressor characteristics are processed based on user-specified simulation points to provide thermal performance data for the condenser or condensing unit.

U.S. Pat. No. 7,010,926 for Condensing unit performance simulator and method by inventors Bahel et al., filed Aug. 17, 2004 and issued Mar. 14, 2006, discloses a system and method for determining thermal performance of a condensing unit including selecting the condensing unit from a condensing unit database and a compressor from a compressor database. Condensing unit characteristics and compressor characteristics are processed based on simulation points to provide thermal performance data for the condensing unit.

U.S. Pat. No. 10,885,238 for Predicting future indoor air temperature for building by inventors Packer et al., filed Aug. 21, 2014 and issued Jan. 5, 2021, discloses a method and system for calculating an estimated future indoor air temperature for a building receiving information about the building, information about environmental conditions, and thermostat set point information, determining, using a processor, thermodynamic properties of the building based on the received information about the building, and calculating the estimated future indoor air temperature using the determined thermodynamic properties of the building, the received information about environmental conditions, and the received thermostat set point information.

European Patent Publication No. 2,626,754 for Simulation environment for building automation by inventors Westerheide et al., filed Feb. 7, 2012 and published Aug. 14, 2013, discloses an arrangement having a simulation computer (1) for receiving spatial information, design of an air conditioning system, physical and environmental conditions of rooms as inputs over models. A simulation software is executed in the simulation computer. A building automation software (6) runs in an automation computer (5) that is connected to the simulation computer via a network (4), where communication between the automation computer and the simulation computer is organized according to a layer model. The simulation computer comprises a simulation server (2) and multiple simulation clients (3). An independent claim is also included for a method for simulating behavior of an air conditioning system that is utilized for air conditioning of a room of a building.

SUMMARY OF THE INVENTION

The present invention relates to systems and methods for simulating air conditioner performance, and more specifically to systems and methods for evaluating air conditioner outputs at various part-load conditions and simulating air conditioning units with various operating parameters in order to achieve desired set point conditions.

It is an object of this invention to provide information and suggestions to achieve optimal air conditioner performance for a particular use-case for the vast majority of relevant conditions, namely part-load conditions.

In one embodiment, the present invention is directed to a system for simulating air conditioner performance at part-load conditions, including a device, including a processor and a memory, wherein the device receives a selection of one or more sets of condition parameters of at least one heating, air conditioning, and ventilation (HVAC) device, wherein the one or more sets of condition parameters include at least one set of condition parameters indicating a part-load condition for the at least one HVAC device, wherein the device receives a selection of one or more part load components for the at least one HVAC device, wherein the device determines whether the one or more part-load components meet one or more preestablished criteria, wherein, if the one or more part-load components are determined to be sufficient, the device generates operating parameters for the at least one HVAC device at each of the one or more sets of condition parameters, wherein the device does not generate the operating parameters if the one or more part-load components are not determined to be sufficient, and wherein the operating parameters include a leaving air dew point temperature, a leaving air dry bulb temperature, and/or a leaving air wet bulb temperature for each of the at least one HVAC device.

In another embodiment, the present invention is directed to a method for simulating air conditioner performance at part-load conditions, including providing a device, including a processor and a memory, the device receiving a selection of one or more sets of condition parameters of at least one heating, air conditioning, and ventilation (HVAC) device, the one or more sets of condition parameters including at least one set of condition parameters indicating a part-load condition for the at least one HVAC device, the device receiving a selection of one or more part load components for the at least one HVAC device, the device determining whether the one or more part-load components meet one or more preestablished criteria, upon determining the one or more part-load components are sufficient, the device generating operating parameters for the at least one HVAC device at each of the one or more sets of condition parameters, and wherein the operating parameters including a leaving air dew point temperature, a leaving air dry bulb temperature, and/or a leaving air wet bulb temperature for each of the at least one HVAC device.

In yet another embodiment, the present invention is directed to a system for simulating air conditioner performance at part-load conditions, including a device, including a processor and a memory, wherein the device receives a selection of one or more sets of condition parameters of at least one heating, air conditioning, and ventilation (HVAC) device, wherein the one or more sets of condition parameters include at least one set of condition parameters indicating a part-load condition for the at least one HVAC device, the device generates operating parameters for the at least one HVAC device at each of the one or more sets of condition parameters by iteratively simulating the at least one HVAC device using different condenser airflow parameters, compressor capacity parameters, compressor staging, fan speed, and/or hot gas reheat percentage parameters within limits of the at least one HVAC device and checking to ensure liquid line pressure of the at least one HVAC device is within predetermined threshold limits during the simulation, and wherein the operating parameters include a leaving air dew point temperature, a leaving air dry bulb temperature, and/or a leaving air wet bulb temperature for each of the at least one HVAC device.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 3 illustrates a unit selection GUI according to one embodiment of the present invention.

FIG. 5 illustrates a part-load simulation GUI according to one embodiment of the present invention.

FIG. 6A illustrates a chart of air conditioner performance data at standardized conditions generated by the system according to one embodiment of the present invention.

FIG. 6B illustrates a chart of air conditioner performance data at standardized conditions generated by the system according to one embodiment of the present invention.

FIG. 7A illustrates a chart of air conditioner performance data at custom part-load conditions generated by the system according to one embodiment of the present invention.

FIG. 7B illustrates a chart of air conditioner performance data at custom part-load conditions generated by the system according to one embodiment of the present invention.

DETAILED DESCRIPTION

Figure 1:
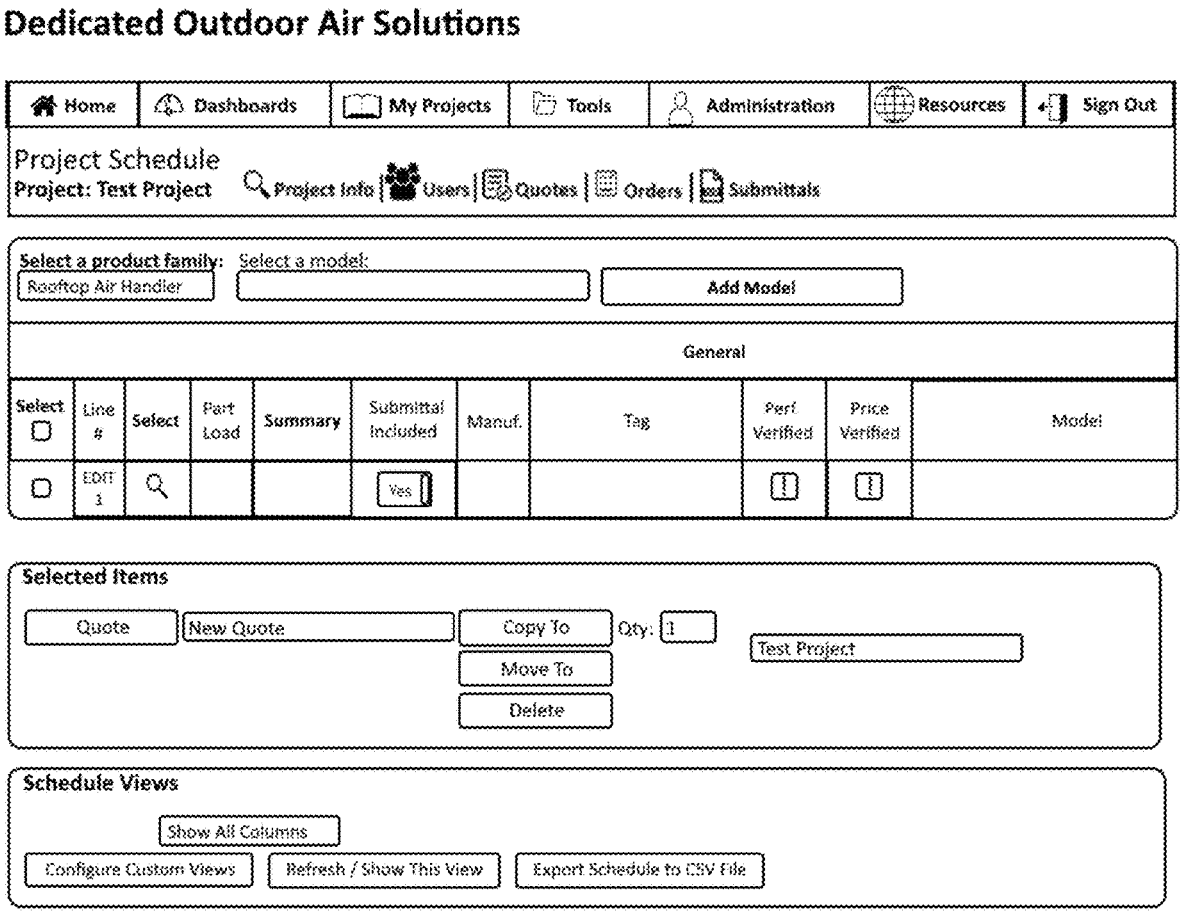
FIG. 1 illustrates a project creation graphical user interface (GUI) according to one embodiment of the present invention.

The present invention is generally directed to systems and methods for simulating air conditioner performance, and more specifically to systems and methods for evaluating air conditioner outputs at various part-load conditions and simulating air conditioning units with various operating parameters in order to achieve desired set point conditions.

In one embodiment, the present invention is directed to a system for simulating air conditioner performance at part-load conditions, including a device, including a processor and a memory, wherein the device receives a selection of one or more sets of condition parameters of at least one heating, air conditioning, and ventilation (HVAC) device, wherein the one or more sets of condition parameters include at least one set of condition parameters indicating a part-load condition for the at least one HVAC device, wherein the device receives a selection of one or more part load components for the at least one HVAC device, wherein the device determines whether the one or more part-load components meet one or more preestablished criteria, wherein, if the one or more part-load components are determined to be sufficient, the device generates operating parameters for the at least one HVAC device at each of the one or more sets of condition parameters, wherein the device does not generate the operating parameters if the one or more part-load components are not determined to be sufficient, and wherein the operating parameters include a leaving air dew point temperature, a leaving air dry bulb temperature, and/or a leaving air wet bulb temperature for each of the at least one HVAC device.

In another embodiment, the present invention is directed to a method for simulating air conditioner performance at part-load conditions, including providing a device, including a processor and a memory, the device receiving a selection of one or more sets of condition parameters of at least one heating, air conditioning, and ventilation (HVAC) device, the one or more sets of condition parameters including at least one set of condition parameters indicating a part-load condition for the at least one HVAC device, the device receiving a selection of one or more part load components for the at least one HVAC device, the device determining whether the one or more part-load components meet one or more preestablished criteria, upon determining the one or more part-load components are sufficient, the device generating operating parameters for the at least one HVAC device at each of the one or more sets of condition parameters, and wherein the operating parameters including a leaving air dew point temperature, a leaving air dry bulb temperature, and/or a leaving air wet bulb temperature for each of the at least one HVAC device.

In yet another embodiment, the present invention is directed to a system for simulating air conditioner performance at part-load conditions, including a device, including a processor and a memory, wherein the device receives a selection of one or more sets of condition parameters of at least one heating, air conditioning, and ventilation (HVAC) device, wherein the one or more sets of condition parameters include at least one set of condition parameters indicating a part-load condition for the at least one HVAC device, the device generates operating parameters for the at least one HVAC device at each of the one or more sets of condition parameters by iteratively simulating the at least one HVAC device using different condenser airflow parameters, compressor capacity parameters, compressor staging, fan speed, and/or hot gas reheat percentage parameters within limits of the at least one HVAC device and checking to ensure liquid line pressure of the at least one HVAC device is within predetermined threshold limits during the simulation, and wherein the operating parameters include a leaving air dew point temperature, a leaving air dry bulb temperature, and/or a leaving air wet bulb temperature for each of the at least one HVAC device.

None of the prior art discloses systems or methods for automatically generating part-load performance data for an air conditioning unit, and none of the prior art discloses modifying operating parameters of an air conditioning unit based on part-load performance data in order to achieve a target dew point temperature and/or a target supply air dry bulb temperature for the air conditioning unit.

When choosing an air conditioner for a building, engineers will often select one or more design conditions, or full-load conditions, at which the air conditioner is expected to perform optimally and choose an air conditioner model and operating parameters for the air conditioner based on achieving those design conditions. For example, an engineer might design for an outdoor dry bulb air temperature of 95° F. and an outdoor wet-bulb temperature of 75° F. and a summer indoor air temperature of 75° F. Based on guidance provided by the American Society of Heating, Refrigerating, and Air-Conditioning Engineers (ASHRAE) and the Air Conditioning Contractors of America (ACCA), design conditions are selected based on the geographic location of the air conditioner and typically selected such that the air conditioner is able to operate at some of the most extreme temperatures for the geographic location, which are conditions that often only exist for 1% of a year. Thus, for the vast majority of a year, air conditioners are not operating at design load conditions and are instead operating at part-load conditions.

Air conditioners do not perform the same at part-load conditions as they do at design conditions. One notable issue with part-load conditions is humidity control. While at full-load conditions, air conditioners are typically designed to deliver air with a particular dew point temperature (most commonly 55° F.) to a space, such that the space achieves a particular relative humidity (typically below 60%), the same air conditioning devices often fail to achieve these same ideal humidity settings when the outdoor air temperature is lower than design temperature conditions. At part-load conditions, the air conditioner must deliver warmer air to the space to avoid overcooling the space outside a range of comfort. However, delivering warmer air to the space often requires cycling (e.g., modulating or turning on and off) the system's compressor, which ultimately causes the system to dehumidify the air less while also delivering warmer air, which often causes the relative humidity in the space to be elevated beyond comfortable conditions. Systems have attempted to address this issue in a variety of ways, including hot gas reheat coils and the use of desiccants.

Even if an engineer selects an air conditioning system having a manner of dealing with part load conditions, such as a hot gas reheat unit, a problem remains of selecting operating parameters to ensure the unit performs adequately under common part load conditions. However, current programs for calculating air conditioner performance are only able to simulate the air conditioner at design conditions, while convenient ways in which to evaluate part load conditions do not exist. In fact, proper evaluation of how an air conditioner model will perform at a single part load condition often take up to a day or more to calculate, making evaluation of many different part load conditions particularly difficult and time consuming. Moreover, even if an engineer manages to determine how an air conditioner having one set of operating parameters performs at a particular part load condition, this calculation does not determine if and how the operating parameters of the air conditioning model are able to be changed in order to meet the desired temperature and humidity settings for a space. Therefore, there is a need for a system to determine air conditioner performance at part-load conditions and provide operating parameters for the air conditioner in order to meet desired temperature and humidity conditions.

Referring now to the drawings in general, the illustrations are for the purpose of describing one or more preferred embodiments of the invention and are not intended to limit the invention thereto.

In one embodiment, the system includes a server platform, having a processor and memory, in communication with at least one database. In one embodiment, the server platform is in wireless and/or wired communication with at least one user device. In one embodiment, each of the at least one user device is associated with a user profile including stored data and preference information.

FIG. 1 illustrates a project creation graphical user interface (GUI) according to one embodiment of the present invention. In one embodiment, the system receives a selection of an existing air conditioning unit model from a user device. As shown in FIG. 1, in one embodiment, the system generates a GUI including a drop-down list of available air conditioning unit models to select. In one embodiment, the GUI provides a filter tool, for filtering out different types of air conditioning unit models.

Figure 2:
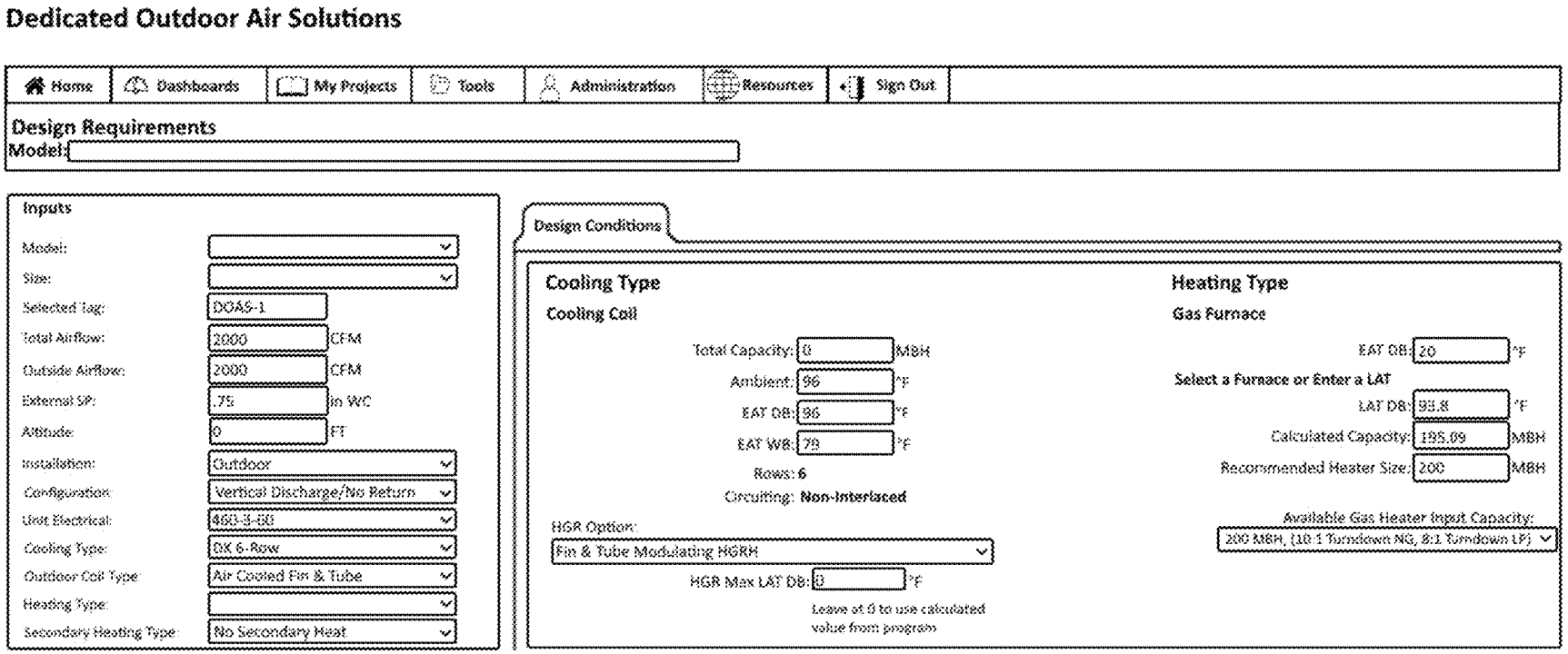
FIG. 2 illustrates a parameter selection GUI for a new project according to one embodiment of the present invention.

FIG. 2 illustrates a parameter selection GUI for a new project according to one embodiment of the present invention. In another embodiment, the system receives a list of specifications for an air conditioning unit model from a user device. By way of example, and not of limitation, in one embodiment, the system receives a selection of an air conditioning unit model, a model size, a total airflow, an outside airflow, an external static pressure (SP) value, an altitude (e.g., feet about sea level), an installation type, a configuration type, an electrical connection type (e.g., voltage, phase, and/or frequency specifications), a cooling type, an outdoor coil type, a heating type, and/or secondary heating type (or a designation of no secondary heating). In another embodiment, the system further receives a selection of a total capacity for a cooling coil, an ambient air temperature for the cooling coil, an entering air dry-bulb temperature (EAT DB) for the cooling coil, and/or an entering air wet-bulb temperature (EAT WB) for the cooling coil. In one embodiment, the system receives a list of additional features and/or capabilities added on to each air conditioning unit model (e.g., a hot gas reheat unit, an energy recovery ventilator). In one embodiment, each selected air conditioning unit model is added to a list of air conditioning units associated with each user profile. After adding a new model to the list of air conditioning units, the system is operable to receive a selection to view performance details, edit, delete, and/or calculate part-load condition performance data for each air conditioning unit on the list of air conditioning units.

FIG. 3 illustrates a unit selection GUI according to one embodiment of the present invention. In one embodiment, once an air conditioning unit and operating parameters are selected, the system automatically generates a list of one or more variations on the selected air conditioning unit (e.g., unit sizes). In one embodiment, for each variation on the selected air conditioning unit, the system provides a plurality of operating values for the air conditioning unit, including, but not limited to, the total cubic feet per minute (CFM) of air flow, the CFM of air flow from outside air, the external static pressure (ESP), the total static pressure (TSP), the fan motor brake horsepower (BHP), the fan motor horsepower (HP), the gross heating and/or cooling capacity of the unit (e.g., measured in MBH or Btu/hr), the net heating and/or cooling capacity of the unit (e.g., measured in MBH or Btu/hr), the gross sensible heating and/or cooling capacity of the unit (e.g., measured in MBH or Btu/hr), the net sensible heating and/or cooling capacity of the unit (e.g., measured in MBH or Btu/hr), the dry-bulb temperature and/or wet-bulb temperature of air entering the air coil, the dry-bulb temperature and/or wet-bulb temperature of air leaving the air coil, the dry-bulb temperature and/or wet-bulb temperature of air leaving the air conditioning unit (after reheat), the face velocity (e.g., measured in feet per minute (fpm)), the number of rows of the evaporator coil of the air conditioning unit, the number of fins per inch (FPI) for the evaporator coil, the energy efficiency ratio (EER) of the air conditioning unit, the face area of the evaporator coil, and/or the wattage of the air conditioning unit. In one embodiment, the system provides for click selection for the one or more variations of the air conditioning unit to allow a user to make a final selection.

Figure 4:
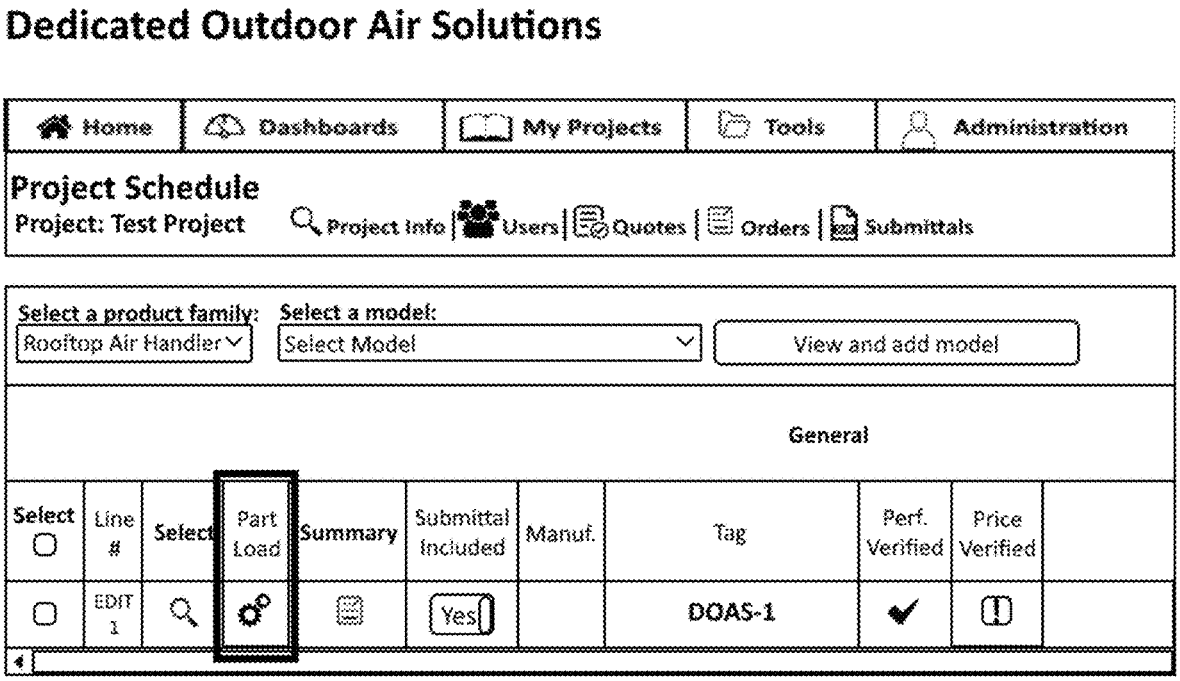
FIG. 4 illustrates a unit list GUI including a selectable option to run part-load simulations for one or more units according to one embodiment of the present invention.

FIG. 4 illustrates a unit list GUI including a selectable option to run part-load simulations for one or more units according to one embodiment of the present invention. As shown in FIG. 4, once the system has received a selection for an air conditioning unit and operating parameters for the air conditioning unit, the selected air conditioning unit is added to a list of projects for a user profile. Through the list of projects, the system is able to receive a selection to view a summary of each unit, receive an edit of each unit, display whether performance data has been generated for the unit, display whether a price quote has been received for the unit, provide user-generated and/or system-generated tags for the unit, and/or receive a selection to utilize a part-load calculator module for the unit.

FIG. 5 illustrates a part-load simulation GUI according to one embodiment of the present invention. The system includes a part-load calculator module, which calculates estimated performance data for the air conditioner unit at one or more part-load environmental conditions (e.g., temperature and/or humidity conditions). In one embodiment, the system disables use of the part-load calculator module if one or more different conditions, examples of which are shown in FIG. 5, are not met by the unit for which part load data is being requested. In one embodiment, the part-load calculator module is disabled for units that do not have validated unit performance data for full-load conditions. Because, in one embodiment, the system uses full-load performance data to determine how a unit will function under one or more part-load conditions, disabling the part-load calculator module in instances where such performance data is not provided is important for ensuring that accurate estimations are able to be made. In one embodiment, full-load performance data is based, in part, on historical data from one or more existing air conditioner systems having the same or similar components as the unit being estimated. In one embodiment, full-load performance data is based, in part, on live performance data from one or more existing air conditioner systems having the same or similar components as the unit being estimated. In one embodiment, the relationship between full-load performance data and performance at one or more part-load conditions is based, in part, on historical data from one or more existing air conditioner systems having the same or similar components as the unit being estimated. In one embodiment, the relationship between full-load performance data and performance at one or more part-load conditions is based, in part, on live performance data from one or more existing air conditioner systems having the same or similar components as the unit being estimated.

In one embodiment, the system disables use of the part-load calculator module if the selected unit does not include one or more part-load control features. Examples of part-load control features include, but are not limited to, a digital scroll compressor, a hot gas reheat coil, head pressure control systems, and/or an airflow monitor (e.g., a piezo ring). In another embodiment, an air flow monitor is not included as a part-load control feature. Part-load control features are features that the system identifies are often necessary in order to control operating parameters of an air conditioning system such that the system is able to operate reasonably well at part-load conditions. Often, the system identifies units without part-load control features as performing poorly enough at important part-load conditions that analysis is less likely to bear useful results, or identifies systems without part-load control features as being incapable of having operating parameters manipulated in order to meet desired temperature and/or humidity levels at part-load conditions. In one embodiment, the system disables the part-load calculator module if the selected air conditioning unit is not a direct expansion system. In one embodiment, the system disables the part-load control module if the calculated dew point of supply air is lower than a preset threshold (e.g., 55° F., 50° F., 45° F., etc.).

In one embodiment, the system generates a graphical user interface (GUI) that allows a user to select a part-load condition for which to generate performance data for the selected air conditioning unit. In one embodiment, the part-load condition includes an outside dry-bulb temperature, an outside wet-bulb temperature, a relative humidity, and/or an outside dew point temperature.

FIG. 6A illustrates a chart of air conditioner performance data at standardized conditions generated by the system according to one embodiment of the present invention. In one embodiment, the system automatically generates performance data for one or more standard industry conditions.

This is useful because it indicates to an engineer how a unit will perform in basic testing conditions, in addition to any customized part-load points added by a user that are applicable to a specific situation. In one embodiment, the standard industry conditions include Standard Rating Conditions A-D for Direct Expansion-Dedicated Outdoor Air System Units (DX-DOAS Units) according to Standard 920 (2020) of the Air-Conditioning, Heating, & Refrigeration Institute (AHRI), which is incorporated herein by reference in its entirety. As shown, in FIG. 6A, the air flow, as measured in cubic feet per minute (CFM), is shown based on an input received from a user device. The ambient dry-bulb temperature, outdoor air dry-bulb temperature, and the outdoor air wet-bulb temperature are set according in accordance with the one or more standard industry conditions. By way of example and not of limitation, for Condition A of AHRI Standard 920 (2020), the ambient dry-bulb temperature and outdoor air dry-bulb temperature are 95° F., and the outdoor wet-bulb temperature is 78° F. For Condition B of AHRI Standard 920 (2020), the ambient dry-bulb temperature and outdoor air dry-bulb temperature are 80° F., and the outdoor wet-bulb temperature is 73° F. For Condition C of AHRI Standard 920 (2020), the ambient dry-bulb temperature and outdoor air dry-bulb temperature are 70° F., and the outdoor wet-bulb temperature is 66° F. For Condition D of AHRI Standard 920 (2020), the ambient dry-bulb temperature and outdoor air dry-bulb temperature are 63° F., and the outdoor wet-bulb temperature is 59° F.

In one embodiment, if the system receives an input that the air conditioning unit being tested includes an energy recovery ventilator (ERV), then the system automatically calculates the estimated dry-bulb temperature and/or wet-bulb temperature of the air after it passes through the ERV. In one embodiment, the system automatically calculates the total capacity of the air conditioner, the sensible capacity of the air conditioner, and/or the latent capacity of the air conditioner. In one embodiment, the system automatically calculates the estimated dry-bulb temperature, wet-bulb temperature, and/or dew point temperature of air after it passes over the evaporator coil, as shown in FIG. 6B. In one embodiment, if the dew point temperature of air after it passes over the evaporator coil for Conditions B, C, and D are not within +/−0.3° F. of the dew point temperature at Condition A, then a warning is transmitted that the dew point temperature is not within recommended specifications.

In one embodiment, the system automatically calculates the estimated moisture removal capacity (MRC) and/or moisture removal efficiency (MRE) of the air conditioner at each standard condition. In one embodiment, the system automatically calculates an integrated seasonal moisture removal efficiency (ISMRE2), wherein the ISMERE2 is equal to a weighted sum of the MRE at each of the AHRI Standard 920 (2020) conditions, as shown below:

$$ISMRE2=(MRE_A*0.14)+(MRE_B*0.34)+(MRE_C*0.39)+(MRE_D*0.13)$$

In one embodiment, the system automatically calculates the leaving air temperature for the air conditioner after the air passes over a hot gas reheat coil within the air conditioner. In one embodiment, the system automatically calculates a capacity of the hot gas reheat coil. In one embodiment, if the leaving air temperature for the air conditioner after the air passes over a hot gas reheat coil is calculated to be outside of the range of 70° F. to 75° F., then a warning is transmitted to the user device that the leaving air temperature is not within recommended specifications. In one embodiment, the system calculates an amount of supplemental heat (e.g., an amount of heat needed from external sources) required to reach a desired temperature condition. In one embodiment, supplemental heat is defined as the heat required to raise the supply air dry-bulb temperature to 70° F., as defined in AHRI Standard 920 (2020).

FIG. 7A illustrates a chart of air conditioner performance data at custom part-load conditions generated by the system according to one embodiment of the present invention. In one embodiment, the system automatically generates performance data for one or more part-load conditions not put forward under AHRI Standard 920 (2020). In one embodiment, calculations are performed for input conditions received by the system from a user device. In another embodiment, the system automatically performs calculations for part-load conditions determined to be generally and/or determined to be relevant to a geographic location received from the user device. As shown, in FIG. 7A, the air flow, as measured in cubic feet per minute (CFM), is shown based on an input received from a user device. The ambient dry-bulb temperature, outdoor air dry-bulb temperature, and the outdoor air wet-bulb temperature are set according in accordance with the designated part-load conditions received by the system.

In one embodiment, if the system receives an input that the air conditioning unit being tested includes an energy recovery ventilator (ERV), then the system automatically calculates the estimated dry-bulb temperature and/or wet-bulb temperature of the air after it passes through the ERV. In one embodiment, the system automatically calculates the total capacity of the air conditioner, the sensible capacity of the air conditioner, and/or the latent capacity of the air conditioner. In one embodiment, the system automatically calculates the estimated dry-bulb temperature, wet-bulb temperature, and/or dew point temperature of air after it passes over the evaporator coil, as shown in FIG. 7B. In one embodiment, the system automatically calculates the estimated moisture removal capacity (MRC) and/or moisture removal efficiency (MRE) of the air conditioner at each part-load condition. In one embodiment, the system automatically calculates the leaving air temperature for the air conditioner after the air passes over a hot gas reheat coil within the air conditioner. In one embodiment, the system automatically calculates a capacity of the hot gas reheat coil. In one embodiment, if the leaving air temperature for the air conditioner after the air passes over a hot gas reheat coil is calculated to be outside of the range of 70° F. to 75° F., then a warning is transmitted to the user device that the leaving air temperature is not within recommended specifications for the particular part-load condition being analyzed.

Figure 8:
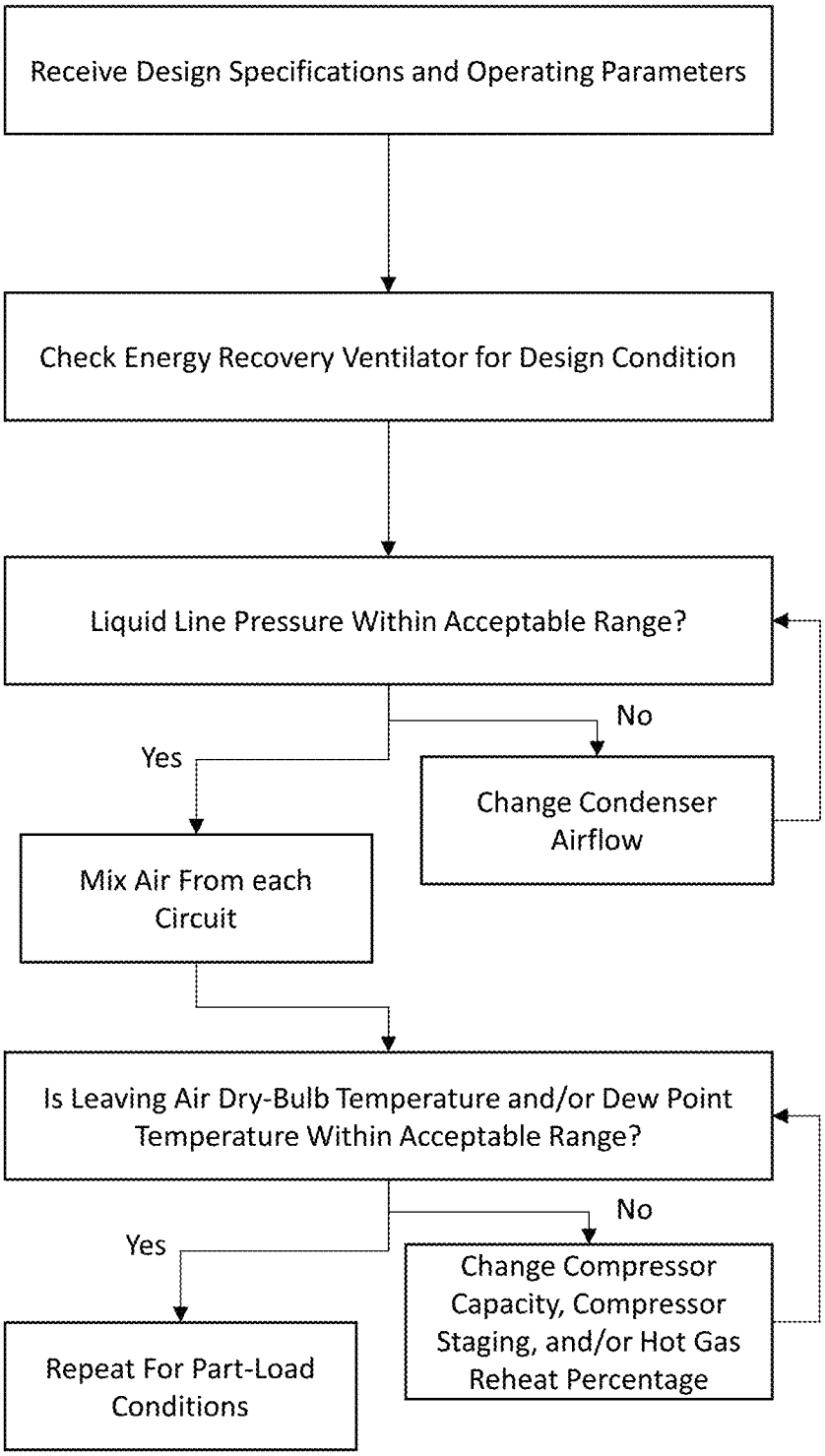
FIG. 8 illustrates a flowchart for generating performance data of an air conditioning unit according to one embodiment of the present invention.

FIG. 8 illustrates a flowchart for generating performance data of an air conditioning unit according to one embodiment of the present invention. In one embodiment, in order to generate performance data, the system first receives a file including design specifications and operating parameters for each unit, including any add-ons chosen for the unit. In one embodiment, the file including the design specifications and operating parameters is a JAVASCRIPT Object Notation (JSON) file. In one embodiment, the design specifications and operating parameters for each unit include, but are not limited to, a model identification number, a size identification number, a name description, a designation of the unit as a cooling system, a heat pump cooling system, or a heat pump heating system, the evaporator air dry-bulb temperature, the evaporator air wet-bulb temperature, the condenser air dry-bulb temperature, the condenser air wet-bulb temperature, a first subcooling level, a last subcooling level, an interval between subcooling levels, an additional amount of liquid subcooling (e.g., from an external source), a degradation factor (e.g., an estimated or measured annual decrease in coefficient of performance for the unit), a superheat temperature, a compressor code number, an electrical power designation (e.g., whether the unit uses a single-phase or three-phase system, whether the unit uses a 50 Hz or 60 Hz cycle, etc.), a wattage for a condenser fan of the unit, a wattage of an evaporator fan of the unit, miscellaneous wattage of additional elements of the unit (e.g., crankcase heater, control transformer, etc.), a system configuration code, a compressor nominal BTUh multiplier, a compressor nominal watts multiplier, and/or a designation of whether there is a dry condenser plan with condensate re-evaporated. In one embodiment, the design specifications and operating parameters includes whether the unit includes a single motor located in the condenser air stream or whether it includes a single motor located in the evaporator air stream. In one embodiment, the design specifications and operating parameters include an evaporator motor efficiency, including a designation of whether the motor is in the air stream. In one embodiment, the design specifications and operating parameters include a designation of whether the compressor is in the air stream, isolated from the air stream, or within an insulated jacket. In one embodiment, the design specifications and operating parameters include a suction line outer diameter, a suction line length indoors, a suction line length outdoors, a liquid line outer diameter, a liquid line length, the presence or absence of a suction service valve, the presence or absence of a liquid service valve, a discharge line outer diameter, and/or a discharge line length. In one embodiment, the design specifications and operating parameters include a number of fins per inch (FPI) for a condenser coil, a number of rows for a condenser coil, a fin height for the condenser coil, a fin material for the condenser coil, a number of circuits for the condenser coil, a number of tubes in each circuit of the condenser coil, and/or a fin length for the condenser coil. In one embodiment, the design specifications and operating parameters include a number of fins per inch (FPI) for an evaporator coil, a number of rows for the evaporator coil, a fin height for the evaporator coil, a fin material for the evaporator coil, a number of circuits for the evaporator coil, a number of tubes in each circuit of the evaporator coil, and/or a fin length for the evaporator coil. In one embodiment, the design specifications and operating parameters include an elevation of the compressor over the evaporator coil and/or an elevation of the condenser coil over the compressor. In one embodiment, the design specifications and operating parameters include a size of an accumulator connection (if present). In one embodiment, the design specifications and operating parameters include at least one air dry-bulb temperature, at least one air wet-bulb temperature, a BTUh value for evaporated condensate, a refrigerant vapor temperature entering the condenser, a refrigerant condensing temperature, a type of refrigerant, a fin coating factor, a fin coating thickness, and/or an altitude above sea level. In one embodiment, the design specifications and operating parameters include a designation of whether each coil is rifled, a groove depth for each coil, a ridge apex angle for each coil, a number of ridges for each coil, and/or a lead helix angle for each coil.

In one embodiment, based on the design specifications and operating parameters of the air conditioning unit, the system first generates performance data for a design temperature and humidity condition for the air conditioning unit. In one embodiment, the design temperature and humidity condition is included in the file. In another embodiment, the design temperature and humidity condition is a consistent standard applied across all units. In one embodiment, the system first performs an energy recovery ventilator (ERV) check, which includes verifying that the use of the ERV is efficient given the supply air and return air temperatures. In one embodiment, the system then simulates the liquid line pressure (the pressure of refrigerant leaving the condenser) of the air conditioning unit. If the liquid line pressure is out of a predetermined acceptable range, then the system automatically readjusts the operating parameters of the air conditioning unit and rechecks the liquid line pressure, repeating the process until the liquid line pressure is within the predetermined acceptable range. In a preferred embodiment, the operating parameter changed in order to manipulate the liquid line pressure is the condenser airflow rate (e.g., simulating change in operation of condenser fans). By way of example, and not of limitation, in one embodiment, manipulating the condenser airflow rate involves decreasing fan speed (decreasing airflow rate) when liquid line pressure is low, and increasing fan speed (increasing airflow rate) when the liquid line pressure is high. Adjusting liquid line pressure is important, as insufficient liquid line pressure prevents the hot gas reheat coil from appropriately reheating the leaving air to desired conditions. Based on the operating parameters wherein the liquid line pressure is acceptable, the system then determines the leaving air temperature, moisture removal capacity, moisture removal efficiency, evaporator wet-bulb temperature, evaporator dry-bulb temperature, and evaporator dew point temperature of the air conditioning unit at the design condition. If the air conditioner includes at least two separate refrigeration circuits, the system then mixes the air coming from each circuit to determine a single leaving air dry-bulb and wet-bulb leaving air temperature for the air conditioning unit. In one embodiment, if the leaving air dry-bulb temperature, leaving air wet-bulb temperature, or leaving air dew point temperatures are outside of a predetermined acceptable range, then the system automatically adjusts operating parameters of the air conditioning unit and re-calculates the performance data.

In one embodiment, the operating parameters altered by the simulation include condenser airflow, compressor capacity, compressor staging (e.g., for systems with multiple compressors, which compressors are on), and hot gas reheat percentage. In one embodiment, the system automatically adjusts compressor capacity and/or compressor staging when leaving air dew point temperature is not within a predetermined range (e.g., between about 40° F. and about 50° F., between about 45° F. and about 55° F., etc.). In one embodiment, the system automatically adjusts condenser airflow when liquid line pressure is not within a predetermined range. In one embodiment, the system automatically adjusts hot gas reheat percentage when the leaving air dry-bulb temperature is not within a predetermined range. By simulating the air conditioning unit with different operating parameters, the system is able to determine whether the air conditioning unit is able to achieve desired conditions, and with what operating parameters those conditions are able to be achieved in different environmental conditions.

In one embodiment, after the system has generated the expected performance data of the air conditioning unit at the design condition, the system then selects one or more part-load conditions having the same target dew point temperature as the resultant dew point temperature achieved at the design condition. The system repeats the process used for the design condition for each part-load condition, including checking the ERV, checking the liquid line pressure, adjusting operating parameters as needed to ensure an acceptable liquid line pressure value, mixing the air coming from separate circuits for a multi-circuit air conditioning unit, and then calculating performance data. Finally, the system selects any remaining part-load conditions and generates performance data. In one embodiment, instead of starting with a design condition for the air conditioning unit, the system starts by generating performance data for the air conditioning unit at a standard condition set by AHRI Standard 920 (2020).

The calculated performance data (e.g., total capacity, sensible capacity, evaporator dry-bulb temperature, evaporator wet-bulb temperature, evaporator dew point temperature, moisture removal capacity, moisture removal efficiency, hot gas reheat leaving air temperature, hot gas reheat capacity, and/or supplemental heat) are determined according to equations and psychrometric charts known to one of ordinary skill in the art. In one embodiment, an external calculator is used to generate the performance data based on input parameters provided by the system.

In one embodiment, the system automatically transmits an alert message to a communication method (e.g., email, text message, automated voicemail, social media direct message, etc.) associated with the user profile when the part-load calculator module is finished generating performance data.

Figure 9:
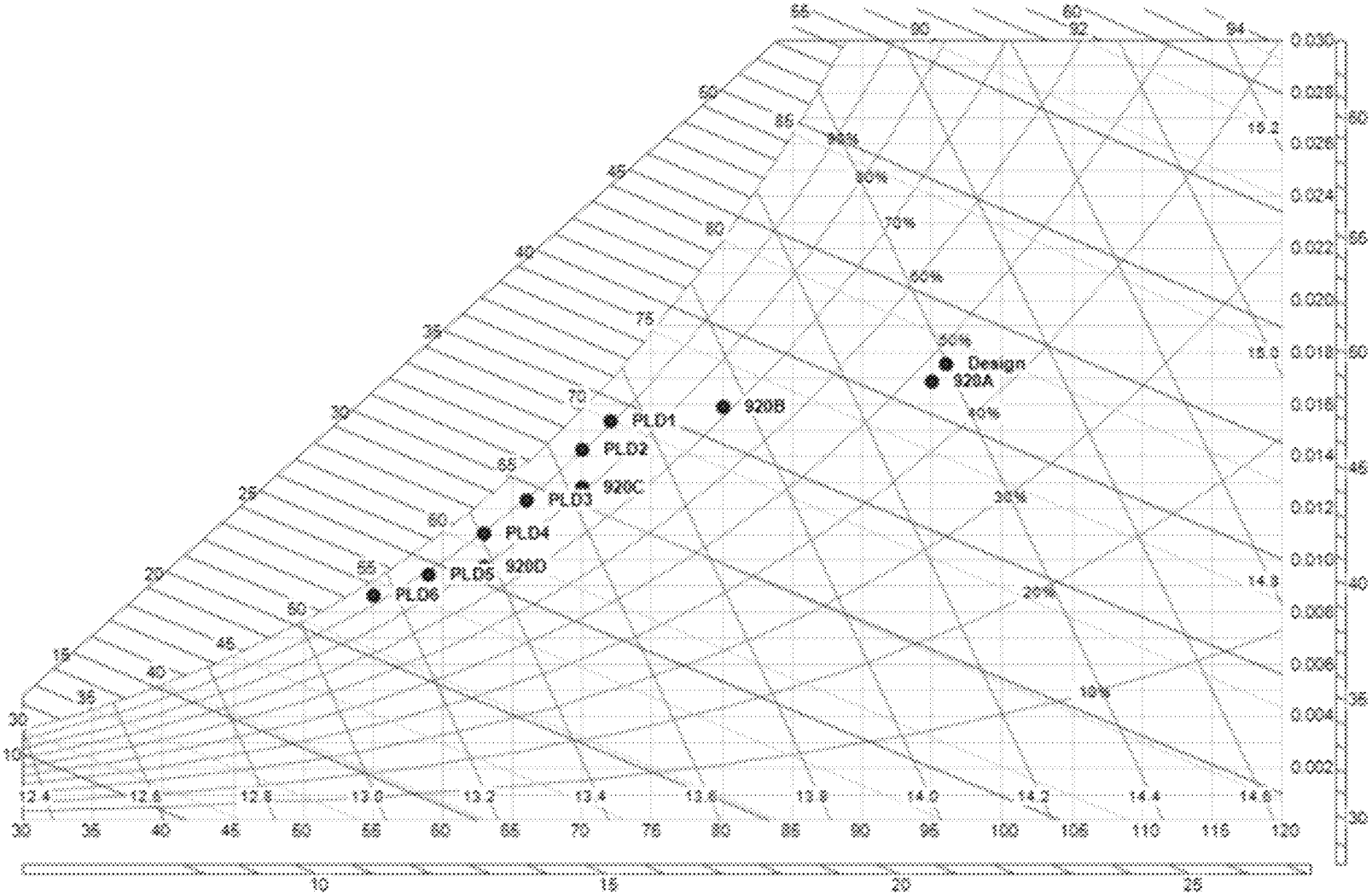
FIG. 9 illustrates a psychrometric chart generated by the system, plotting a plurality of user set point conditions in addition to standard conditions according to one embodiment of the present invention.

FIG. 9 illustrates a psychrometric chart generated by the system, plotting a plurality of user set point conditions in addition to standard conditions according to one embodiment of the present invention. In one embodiment, the part-load calculator module automatically generates at least one psychrometric chart including any standard conditions and/or any user defined set point conditions being evaluated by the part-load calculator module. By displaying a psychrometric chart, a user is able to more easily visualize what conditions are being evaluated by the part-load calculator module and how the user-defined set point conditions differ from the design condition and/or other standard conditions. One of ordinary skill in the art will understand the axes and values represented on the psychrometric chart shown in FIG. 9 to be standard relative to psychrometric charts used in the industry. In one embodiment, in order to determine performance and parameters at a user set point condition that is between two standard conditions, the system automatically interpolates the performance data to find a point that is intermediate between the two nearest standard conditions. While, in reality, the HVAC system is likely to oscillate between two states rather than reach a single, stable set of parameters at the user defined point, interpolating the data and presenting a single set of parameters is often useful for approximating the performance of the device.

In one embodiment, the system is in wireless communication with at least one air conditioning device. The system is operable to receive one or more part-load trigger conditions from a user device for the at least one air conditioning device. In one embodiment, the one or more part-load trigger conditions are designated part-load conditions for which the part-load calculator module has calculated suggested operating parameters and performance data for the suggested operating parameters. In one embodiment, the system is in wireless communication with at least one temperature sensor and/or at least one humidity sensor. The at least one temperature sensor transmits outdoor air temperature data to the system's server and the at least one humidity sensor transmits outdoor air humidity data the system's server. When the at least one temperature sensor and/or at least one humidity sensor detect that the outdoor air conditions match at least one of the part-load trigger conditions, the system commands and controls the at least one air conditioning device to automatically adopt the suggested operating parameters. By way of example, and not of limitation, in one embodiment, if the at least one temperature sensor and/or at least one humidity sensor detect conditions substantially close to a previously run part-load condition and detects that liquid line pressure will be too low, the system automatically causes the condenser fans in the air conditioning unit to slow to levels determined by the previously run part-load condition simulation.

Figure 10:
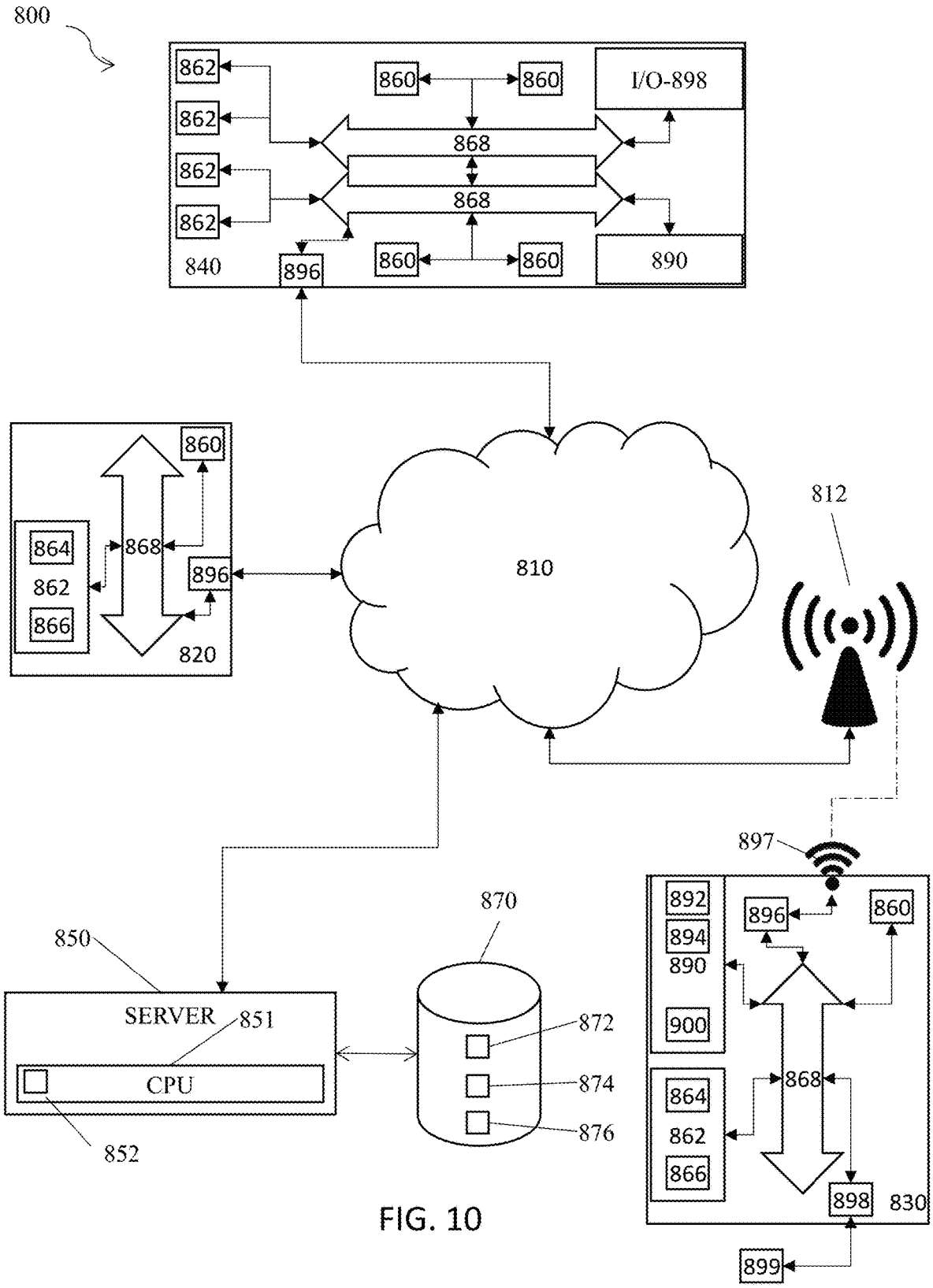
FIG. 10 is a schematic diagram of a system of the present invention.

FIG. 10 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 10, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 10, is operable to include other components that are not explicitly shown in FIG. 10, or is operable to utilize an architecture completely different than that shown in FIG. 10. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A system for simulating air conditioner performance at part-load conditions, comprising:

a device, including a processor and a memory;

wherein the device receives a selection of one or more sets of condition parameters of at least one heating, air conditioning, and ventilation (HVAC) device;

wherein the one or more sets of condition parameters include at least one set of condition parameters indicating a part-load condition for the at least one HVAC device;

wherein the device receives a selection of one or more part load components for the at least one HVAC device;

wherein the device determines whether the one or more part-load components meet one or more preestablished criteria;

wherein, if the one or more part-load components are determined to be sufficient, the device generates operating parameters for the at least one HVAC device at each of the one or more sets of condition parameters;

wherein the device does not generate the operating parameters if the one or more part-load components are not determined to be sufficient; and wherein the operating parameters include, but are not limited to, a leaving air dew point temperature, a leaving air dry bulb temperature, and/or a leaving air wet bulb temperature for each of the at least one HVAC device; and wherein the device receives functional parameters for the at least one HVAC device including a number of rows of an evaporator coil of the at least one HVAC device, a number of fins per inch (FPI) for the evaporator coil, a face area of the evaporator coil, a first subcooling level, a last subcooling level, an interval between subcooling levels, an additional amount of liquid subcooling, a degradation factor, a superheat temperature, and/or a wattage of the at least one HVAC device.

2. The system of claim 1, wherein the one or more part-load components include a digital scroll compressor, a hot gas reheat coil, a head pressure control system, and/or an airflow monitor.

3. The system of claim 1, wherein the functional parameters for the at least one HVAC device including a total cubic feet per minute (CFM) of air flow, a CFM of air flow from outside air, an external static pressure (ESP), a fan motor brake horsepower (BHP), and/or a fan motor horsepower (HP).

4. The system of claim 3, wherein the device receives one or more files in one or more standard file formats and automatically parses the one or more files in order to determine the functional parameters of the at least one HVAC device.

5. The system of claim 1, wherein the at least one HVAC device includes at least one dedicated outdoor air system (DOAS).

6. The system of claim 1, wherein the operating parameters further include a moisture removal capacity (MRC), a moisture removal efficiency (MRE), and/or a hot gas reheat capacity.

7. The system of claim 1, wherein, in order to generate the operating parameters, the device iteratively simulates the at least one HVAC device using different condenser airflow parameters, compressor capacity parameters, compressor staging, fan speed, and/or hot gas reheat percentage parameters within limits of the at least one HVAC device and checks to ensure liquid line pressure of the at least one HVAC device is within predetermined threshold limits during the simulation.

8. The system of claim 7, wherein the device is in network communication with at least one actual HVAC device, and the device transmits instructions to the at least one actual HVAC device to adjust condenser airflow parameters, compressor capacity parameters, compressor staging, fan speed, and/or hot gas reheat percentage based on results of the simulation.

9. A method for simulating air conditioner performance at part-load conditions, comprising:

providing a device, including a processor and a memory;

the device receiving a selection of one or more sets of condition parameters of at least one heating, air conditioning, and ventilation (HVAC) device;

the one or more sets of condition parameters including at least one set of condition parameters indicating a part-load condition for the at least one HVAC device;

the device receiving a selection of one or more part load components for the at least one HVAC device;

the device determining whether the one or more part-load components meet one or more preestablished criteria;

upon determining the one or more part-load components are sufficient, the device generating operating parameters for the at least one HVAC device at each of the one or more sets of condition parameters; and wherein the operating parameters including a leaving air dew point temperature, a leaving air dry bulb temperature, and/or a leaving air wet bulb temperature for each of the at least one HVAC device; and wherein the device receives functional parameters for the at least one HVAC device including a number of rows of an evaporator coil of the at least one HVAC device, a number of fins per inch (FPI) for the evaporator coil, a face area of the evaporator coil, a first subcooling level, a last subcooling level, an interval between subcooling levels, an additional amount of liquid subcooling, a degradation factor, a superheat temperature, and/or a wattage of the at least one HVAC device.

10. The method of claim 9, further comprising the one or more part-load components including a digital scroll compressor, a hot gas reheat coil, a head pressure control system, and/or an airflow monitor.

11. The method of claim 9, wherein the functional parameters for the at least one HVAC device further include a total cubic feet per minute (CFM) of air flow, a CFM of air flow from outside air, an external static pressure (ESP), a fan motor brake horsepower (BHP), and/or a fan motor horsepower (HP).

12. The method of claim 11, further comprising the device receiving one or more files in one or more standard file formats and automatically parsing the one or more files in order to determine the functional parameters of the at least one HVAC device.

13. The method of claim 9, further comprising the at least one HVAC device including at least one dedicated outdoor air system (DOAS).

14. The method of claim 9, further comprising the operating parameters further including a moisture removal capacity (MRC), a moisture removal efficiency (MRE), and/or a hot gas reheat capacity.

15. The method of claim 9, further comprising the device iteratively simulating the at least one HVAC device using different condenser airflow parameters, compressor capacity parameters, compressor staging, fan speed, and/or hot gas reheat percentage parameters within limits of the at least one HVAC device and checking to ensure liquid line pressure of the at least one HVAC device is within predetermined threshold limits during the simulation.

16. The method of claim 9, further comprising the device being in network communication with at least one actual HVAC device, and the device transmitting instructions to the at least one actual HVAC device to adjust condenser airflow parameters, compressor capacity parameters, compressor staging, fan speed, and/or hot gas reheat percentage based on results of the simulation.

17. A system for simulating air conditioner performance at part-load conditions, comprising:

a device, including a processor and a memory;

wherein the device receives a selection of one or more sets of condition parameters of at least one heating, air conditioning, and ventilation (HVAC) device;

wherein the one or more sets of condition parameters include at least one set of condition parameters indicating a part-load condition for the at least one HVAC device;

the device generates operating parameters for the at least one HVAC device at each of the one or more sets of condition parameters by iteratively simulating the at least one HVAC device using different condenser airflow parameters, compressor capacity parameters, compressor staging, fan speed, and/or hot gas reheat percentage parameters within limits of the at least one HVAC device and checking to ensure liquid line pressure of the at least one HVAC device is within predetermined threshold limits during the simulation; and wherein the operating parameters include a leaving air dew point temperature, a leaving air dry bulb temperature, and/or a leaving air wet bulb temperature for each of the at least one HVAC device.

18. The system of claim 17, wherein device receives functional parameters for the at least one HVAC device including a total cubic feet per minute (CFM) of air flow, a CFM of air flow from outside air, an external static pressure (ESP), a fan motor brake horsepower (BHP), a fan motor horsepower (HP), a number of rows of an evaporator coil of the at least one HVAC device, a number of fins per inch (FPI) for the evaporator coil, a face area of the evaporator coil, a first subcooling level, a last subcooling level, an interval between subcooling levels, an additional amount of liquid subcooling, a degradation factor, a superheat temperature, a wattage of the at least one HVAC device, and/or other dimensions and parameters regarding the evaporator coil, a hot gas reheat coil, and/or a compressor of the at least one HVAC device.

19. The system of claim 18, wherein the device receives one or more files in one or more standard file formats and automatically parses the one or more files in order to determine the functional parameters of the at least one HVAC device.

20. The system of claim 17, wherein the at least one HVAC device includes at least one dedicated outdoor air system (DOAS).

* * * * *